US006402274B1

(12) United States Patent
Reis

(10) Patent No.: US 6,402,274 B1
(45) Date of Patent: Jun. 11, 2002

(54) DRAWER SLIDE CONSTRUCTION WITH ANTI-REBOUND FEATURE

(75) Inventor: Norbert Reis, Cambridge (CA)

(73) Assignee: CompX International Inc., Mauldin, SC (US)

( * ) Notice: Subject to any disclaimer, the term of this patent is extended or adjusted under 35 U.S.C. 154(b) by 0 days.

(21) Appl. No.: 09/728,769

(22) Filed: Dec. 1, 2000

Related U.S. Application Data

(63) Continuation-in-part of application No. 09/698,618, filed on Oct. 27, 2000.

(51) Int. Cl.[7] ..... A47B 88/00

(52) U.S. Cl. ..... 312/334.46; 312/334.44; 384/21

(58) Field of Search ..... 312/334.44, 334.46, 312/334.47, 334.1, 334.7, 334.8, 333, 221; 384/20, 21

(56) References Cited

U.S. PATENT DOCUMENTS

| | | | | |
|---|---|---|---|---|
| 3,462,203 A | * | 8/1969 | Del Vecchio | 312/334.47 X |
| 4,936,640 A | * | 6/1990 | Pratzer | 312/221 |
| 4,983,000 A | * | 1/1991 | Rock | 312/333 |
| 5,135,294 A | * | 8/1992 | Ohshima et al. | 312/334.46 X |
| 5,352,020 A | | 10/1994 | Wade et al. | |
| 5,352,030 A | | 10/1994 | Derle et al. | |
| 5,433,517 A | * | 7/1995 | Fleisch | 312/334.46 X |
| 5,709,443 A | * | 1/1998 | Lautenschlager | 312/334.47 X |
| 6,224,177 B1 | * | 5/2001 | Chu | 312/334.46 X |
| 6,254,205 B1 | * | 7/2001 | Wright et al. | 312/221 X |

* cited by examiner

*Primary Examiner*—Peter M. Cuomo
*Assistant Examiner*—Hanh V. Tran
(74) *Attorney, Agent, or Firm*—Banner & Witcoff, Ltd.

(57) ABSTRACT

Anti-rebound drawer slide includes a leaf spring positioned at the inner end of the slide cooperative with a cam that receives an inner slide channel. Rotation of the cam by engagement with the slide channel is controlled and an anti-rebound effect is achieved by virtue of the engagement of the leaf spring with the cam.

4 Claims, 2 Drawing Sheets

FIG. 3
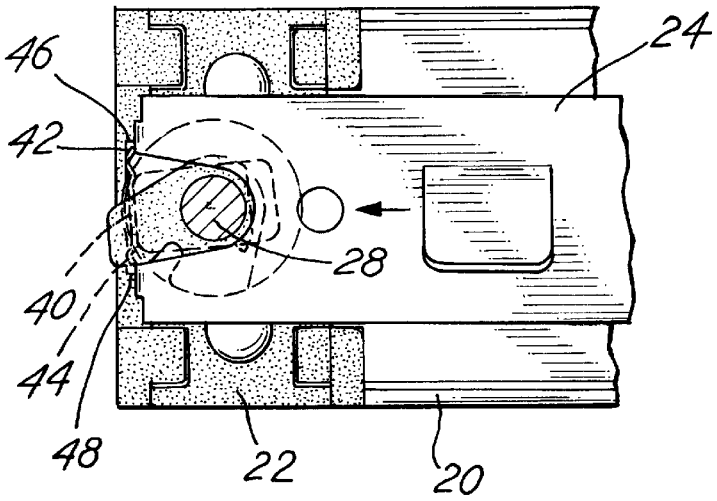
FIG.4A
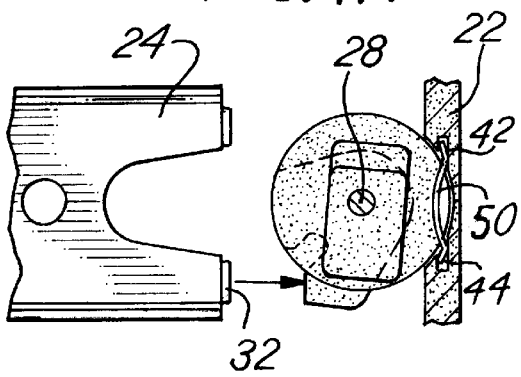
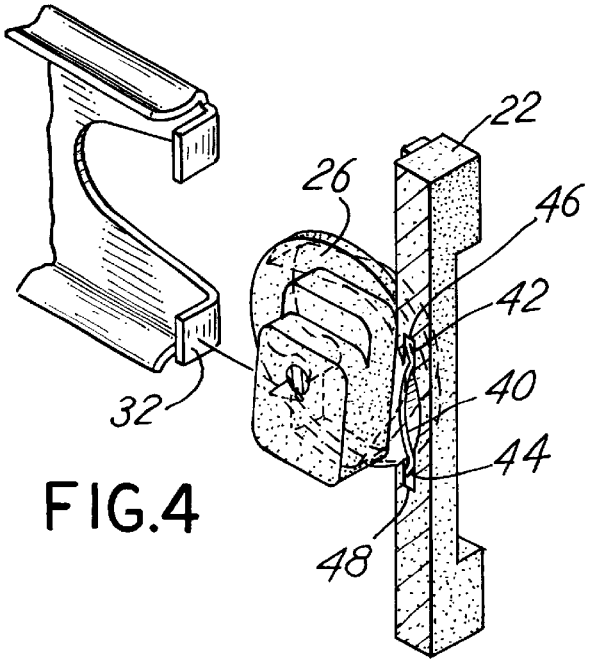
FIG.4
FIG.4B
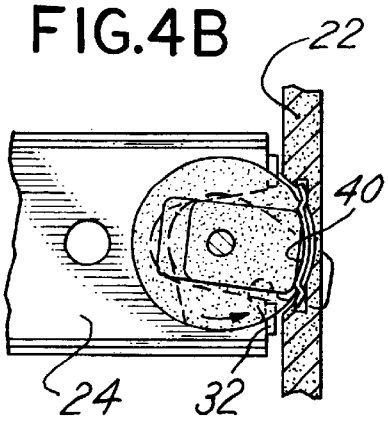

DRAWER SLIDE CONSTRUCTION WITH ANTI-REBOUND FEATURE

This application is a continuation-in-part of application Ser. No. 09/698,618, filed Oct. 27, 2000.

BACKGROUND OF THE INVENTION

In a principal aspect the present invention relates to the improvement in a cabinet drawer slide of a mechanism which precludes or inhibits rebound upon closure of the telescopic channels which comprise the drawer slide.

Heretofore, various types of drawer slides have been made comprised of nested, telescoping channel members or channels which slide with respect to one another to support a drawer in a cabinet and effect drawer movement between a fully closed position and an open position. U.S. Pat. No. 5,352,030 discloses such a drawer slide construction. U.S. Pat. No. 5,352,030 is incorporated herewith by reference.

Typically, drawer slides include two or more nesting, telescoping channels or channel members. The outer or largest channel member is usually fitted against or attached to the inside of a cabinet. The remaining inner telescopic members thus are mounted and slide in the outer channel. Normally, an inner most channel is attached to the side of a drawer. When the channels are telescoped together so that they overlie each other, the drawer is in the closed position within the cabinet. When the inner channels are telescoped with respect to each other and the outer channel, they project or slide outwardly from the outer channel to support a drawer, thereby permitting access to the drawer.

U.S. Pat. No. 5,352,030 discloses mechanisms for interlocking the sliding operation of channels associated with vertically stacked drawers to thereby prevent the opening of more than one drawer at any given time. However, closure of any single drawer to the fully closed position may result in rebound of the drawer as it moves to the closed position. Thus, it is desirable to provide some type of cushion mechanism which enables the channels to bottom out or move to a closed position in a controlled fashion and which otherwise provides cushioning of the impact resulting when channels slide together as the drawer is moved to its closed position.

SUMMARY OF THE INVENTION

Briefly, the present invention comprises a multiple channel drawer slide with an outer channel for attachment to the inside wall of a cabinet and an inner channel telescopically and slidably mounted in the outer channel and attachable to a drawer in the cabinet. The outer channel includes a base plate mounted at the inner end thereof. Attached to the base plate is a rotatable cam member. That cam member rotates in response to moving a cabinet drawer from a closed position to an open position in a fashion which will enable interaction with or control of movement of vertically adjacent drawers. Such a mechanism or construction is taught in U.S. Pat. No. 5,352,030.

With the present invention, the rotating cam member has additional functions beyond the interconnection control function of vertically adjacent drawers to prevent tipping of the cabinet by virtue of permitting only a single drawer to open at any given time. More specifically, the rotating cam member mounted on the inside of the outer channel and located on the base plate at the inside end of the outer channel includes a detent receiving slot for receiving a lug associated with the inner end of the inner channel. That lug engages the detent receiving slot and the cam member then rotates as the inner channel is moved to the fully closed position where the channel is releasably retained by virtue of the engagement of the lug with the detent receiving slot. A biasing spring located in the path of travel of the inner channel is thus engaged with the rotating cam member. More specifically, the rotating cam member includes a cam follower surface with at least two detent positions. The follower surface is engaged by the biasing member or spring. One of the detent surfaces is associated with the fully closed position of the inner channel and simultaneous rotation of the cam member to effect the lug engaging the detent receiving slot thereby releasably holding the inner channel in the fully closed position. Pulling on the inner channel to move the inner channel toward the open position will cause the lug to pull on the detent slot causing the cam member to rotate against the biasing force of the spring member positioned against the follower surface of the cam member. The shape of the cam follower surface, the strength of the spring, and the spacing and position of the spring may all be varied in order to control the retention force as well as the force required for release of the drawer slide from the closed position as it moves toward the open position. The biasing spring also serves the function of reducing rebound and damping movement of the inner channel as it is fully moved to the closed position.

Thus, it is an object of the invention to provide an improved mechanism for retaining a drawer slide channel in the closed position and for controlling rebound as the drawer slide channels are moved to the closed position.

It is a further object of the invention to provide an economic and simple assembly of parts which may be utilized in combination with prior art constructions for maintaining a drawer slide assembly in a closed position and for controlling rebound as the drawer slide channels are moved to the closed position.

Yet another object of the invention is to provide a stop, catch, and anti-rebound mechanism associated with the channels of a drawer slide which is easy to use, economical, rugged and adjustable.

These and other objects, advantages and features of the invention will be set forth in the detailed description as follows.

DESCRIPTION OF THE PREFERRED EMBODIMENT

In the detailed description which follows, reference will be made to the drawing comprised of the following figures:

FIG. 3 is a plan view of the construction of FIG. 1 with the inner channel of the drawer slide in the fully closed position;

FIG. 4 is an isometric view of the cam member engaged by the inner channel as viewed from the back side to illustrate the follower;

FIG. 4A is a partial side view of the mechanism of FIG. 4; and

FIG. 4B is a partial side view of the mechanism of FIG. 4B in closed position.

DESCRIPTION OF THE PREFERRED EMBODIMENT

Figure 1:
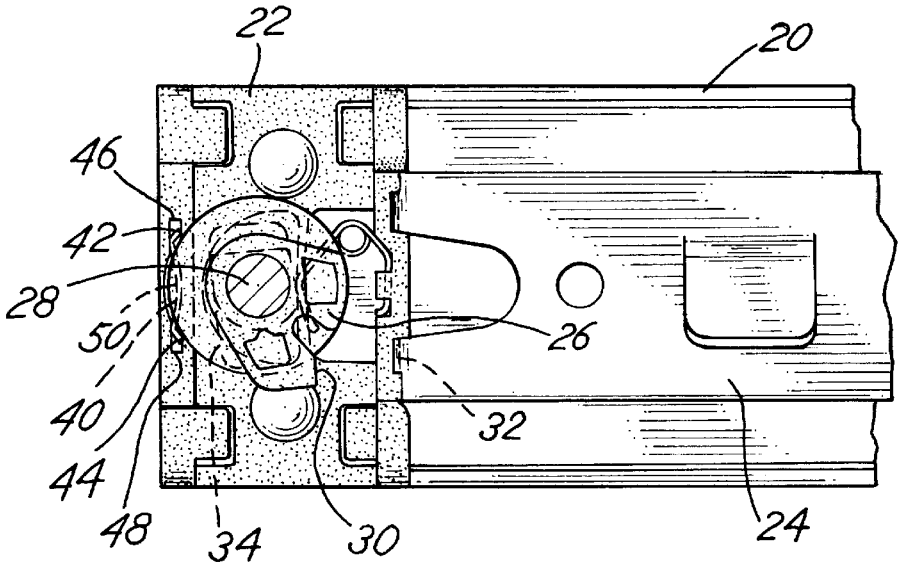
FIG. 1 is an exploded plan view of a drawer slide comprised of multiple channels including an end plate and follower cam member which controls the rebound and retention of a drawer slide.
Figure 2:
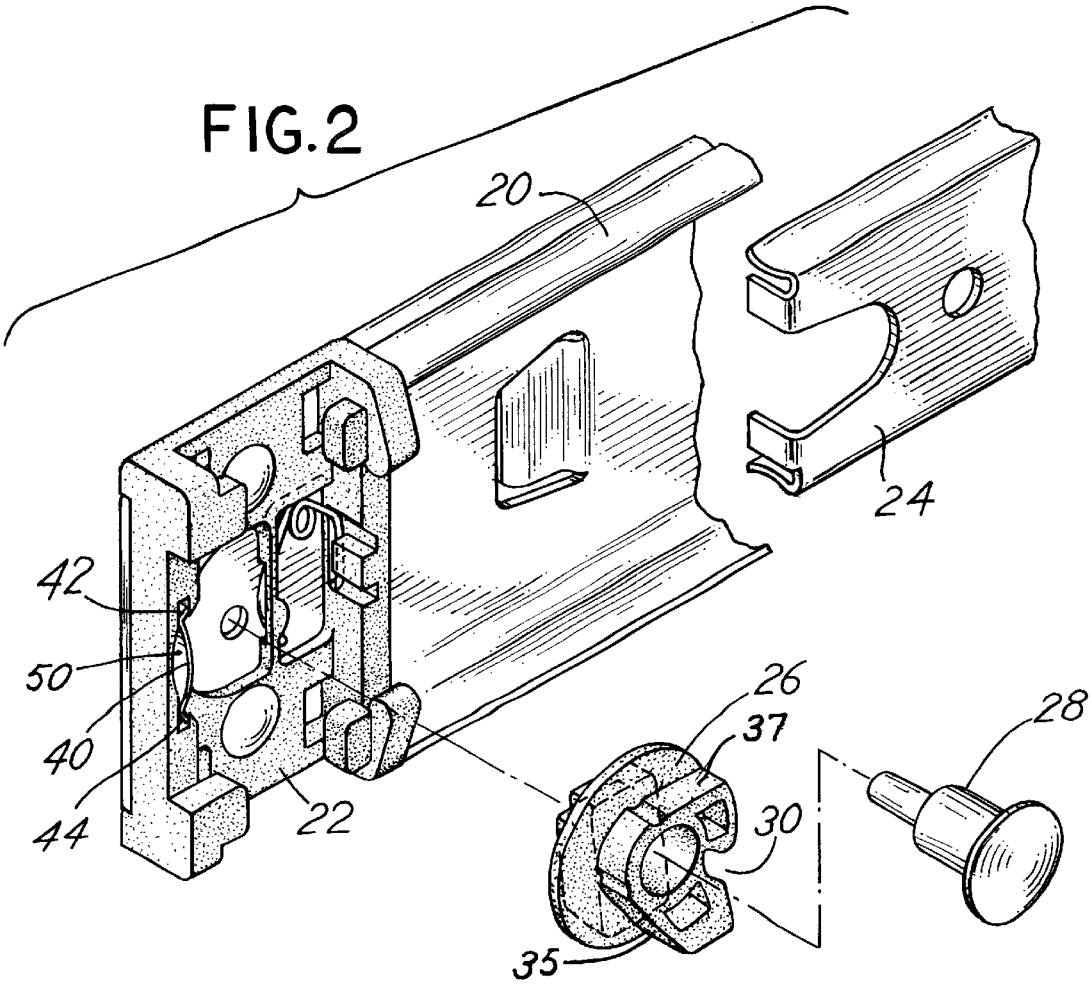
FIG. 2 is an exploded isometric view of the construction depicted in FIG. 1.

The anti-rebound feature of the present invention may be incorporated in various types of multiple channel drawer slides. The following description relates to its incorporation in a slide of the type which may utilize a rotating cam member as part of a mechanism to control the opening of a vertical array of drawers such as depicted in U.S. Pat. No. 5,352,030. The description, however, focuses on the anti-rebound feature and the channel retention feature incorporated with and in the rotating cam. This feature may be incorporated in various slide mechanisms of the type comprised of multiple telescoping and slidable channels.

Thus, referring to the drawings, an outer channel 20 includes an end plate member 22 at the inner end thereof. End plate member 22 may be integral or a separate formed or molded part. One or more channels are slidable within the outer channel 20 in a manner known to those of ordinary skill in the art. Thus, an inner channel 24 is provided. Typically, the inner channel 24 is attached to a drawer (not shown) and the outer channel 20 is attached to the inside of a cabinet wall (not shown). The end plate member 22 further includes a rotatable cam member 26 which is rotatable about a pin 28 attached to the end plate member 22. The cam member 26 includes a detent receiving cam surface or slot 30 for receipt of a lug 32 projecting from the inner end of the inner channel 24. The lug 32 is retained by the detent receiving slot 30 as the inner channel 24 is moved to the fully closed position and the cam member 26 is rotated as depicted in the drawing.

The cam member 26 further includes a cam follower surface 34. The follower surface 34 defines a follower path about the pivot pin 28 radially spaced from the rotation axis of pin 28. The follower surface 34 is engaged by a leaf spring 40 with opposite spring ends 42 and 44 retained respectively in slots 46 and 48 in the end plate 22. Thus, the cam surface or follower surface 34 impinges or engages against a center section 50 of the leaf spring 40. The follower surface 34 includes at least two detent positions 35 and 37. These detent positions 35 and 37, or flats, are the more stable positions of the rotating cam member 26 as engaged by spring 40. Thus, as the inner channel 24 is moved to the fully closed position, the follower detent flat 35 engages against the center 50 of leaf spring 40 to retain the cam member 26 in the closed position. The spring 40 also acts as a buffer or damper as the inner channel 24 is moved to the closed position.

Other alternative stable positions of the cam member 26 are provided by virtue of the shape of follower surface 34. Flat 37 provides another stable or rest point of rotation of cam member 26. Thus, when the channel 24 is moved to the open position, the cam member 26 rotates to a second position and is retained in that position by virtue of interaction of the surface 37 and the leaf spring 40. The cam member 26 is thus retained in position so that lug 32 may engage with the detent 30 and then be rotated as depicted in the drawing by the arrow as the channel member 24 moves to the fully closed position.

The particular type of spring 40 which is used in the device is not a limiting feature of the invention. However, a leaf spring 40 is preferred. It is to be noted that the leaf spring 40 may be replaced quite easily by lifting spring 40 from the slots 46 and 48 and replacement thereof. Various sizes of leaf springs 40 having various thicknesses and spring constants may thus be utilized, depending upon the needs and desires with respect to the loads that are to be placed on the slide construction and the amount of weight retained in the drawers. Spring 40 thus controls the amount of damping or anti-rebound force and also controls the holding force of cam member 24 on lug 32 that results as the inner channel 24 is moved to the closed position.

There has been set forth the preferred embodiment of the invention. Various alternatives may be provided without departing from the spirit and scope of the invention. The invention is, therefore, to be limited only by the following claims and equivalents thereof.

What is claimed is:

1. In a drawer slide comprising, in combination:

an outer channel for attachment to a cabinet, said outer channel including an inner end;

an inner channel telescopically and slidably receive within the outer channel and movable between an open position to a fully closed position, said inner channel including an inner end detent lug;

a spring base plate at the inner end of the outer channel, said spring base plate including a rotating cam member mounted thereon, said cam member including a detent receiving cam for receiving the inner channel detent lug and releasably retaining the lug and inner channel in the fully closed position when the inner channel is in the fully closed position and rotatable to release the lug as the inner channel slides toward an open position; and a spring member mounted on the base plate engaged with the rotating cam member, said rotating cam member including a contoured follower having a first flat detent surface and a second flat detent surface, said spring member, engaged with the first detent surface in the fully closed position, and rotatable by the inner channel detent lug to engage with the second detent surface in the open position.

2. The improvement of claim 1 wherein the spring member is a leaf spring.

3. The improvement of claim 1 wherein the spring member is replaceable and may be replaced to thereby adjust the biasing force on the cam follower.

4. The improvement of claim 2 wherein the leaf spring has opposite ends attached to the base plate and a flexible middle section positioned against the contoured follower.

* * * * *